US012167804B2

(12) United States Patent
Nelson et al.

(10) Patent No.: US 12,167,804 B2
(45) Date of Patent: Dec. 17, 2024

(54) RAIL STORAGE SYSTEM WITH END CAPS

(71) Applicant: TECHTRONIC CORDLESS GP, Anderson, SC (US)

(72) Inventors: Samuel Nelson, Easley, SC (US); Rebekah Hilton, Greenville, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 18/195,745

(22) Filed: May 10, 2023

(65) Prior Publication Data

US 2023/0363553 A1 Nov. 16, 2023

Related U.S. Application Data

(60) Provisional application No. 63/341,815, filed on May 13, 2022.

(51) Int. Cl.
*A47F 5/08* (2006.01)
*A47B 96/06* (2006.01)

(52) U.S. Cl.
CPC ..... *A47F 5/0853* (2013.01); *A47B 96/067* (2013.01)

(58) Field of Classification Search
CPC .... A47F 5/0853; A47F 5/0838; A47F 5/0846; A47B 96/067; A47B 95/008; A47B 96/061; B25H 3/04
See application file for complete search history.

(56) References Cited

U.S. PATENT DOCUMENTS

| | | | |
|---|---|---|---|
| 2,541,828 | A | 2/1951 | Peck |
| 2,695,105 | A | 11/1954 | Mitchell |
| 3,504,405 | A | 4/1970 | Elliott-Smith |
| 4,119,285 | A | 10/1978 | Bisping et al. |
| 4,457,436 | A | 7/1984 | Kelley |
| 5,359,752 | A | 11/1994 | Domenig |
| 5,503,277 | A | 4/1996 | O'Brien |
| 5,601,196 | A | 2/1997 | Heer et al. |
| 5,669,515 | A | 9/1997 | Tisbo et al. |

(Continued)

FOREIGN PATENT DOCUMENTS

| | | | |
|---|---|---|---|
| AU | 2015101015 | B4 | 9/2015 |
| DE | 102010027178 | B4 | 12/2012 |

(Continued)

OTHER PUBLICATIONS

European Search Report corresponding with Application No. EP23172250 on Aug. 31, 2023 (2 pages).

*Primary Examiner* — Ko H Chan
(74) *Attorney, Agent, or Firm* — Dority & Manning, P.A.

(57) ABSTRACT

A storage rail assembly and an end cap system for a storage rail assembly are provided. A storage rail assembly includes a first rail configured to be coupled to a wall. The first rail extends from a left end to a right end along a first longitudinal axis. The assembly further includes a first left end cap coupled to the left end of the rail, the left end cap including a concave pocket extending inwardly from a left face of the first left end cap and having a pocket contact surface; and a right end cap coupled to the right end of the rail, the right end cap including a projection extending outwardly from a right face of the right end cap, wherein the projection is configured to be received in a pocket of a second left end cap to form a horizontal rail assembly.

19 Claims, 11 Drawing Sheets

(56) References Cited

U.S. PATENT DOCUMENTS

| | | | | |
|---|---|---|---|---|
| 5,799,915 | A | 9/1998 | Morey | |
| 5,855,285 | A * | 1/1999 | Laird | B25H 3/003 206/378 |
| 6,109,569 | A * | 8/2000 | Sakaida | F16L 3/222 248/62 |
| 6,499,608 | B1 | 12/2002 | Sterling et al. | |
| 6,564,949 | B1 | 5/2003 | Saathoff | |
| 6,698,603 | B2 | 3/2004 | Lawson | |
| 6,702,128 | B2 * | 3/2004 | Winig | A47B 96/067 211/183 |
| 6,786,340 | B2 * | 9/2004 | Ford | A47F 5/0823 211/103 |
| 7,014,052 | B2 * | 3/2006 | Dettorre | A47F 5/0838 211/94.01 |
| 7,185,770 | B1 * | 3/2007 | Roten | A47B 81/00 211/70.6 |
| 7,591,385 | B2 | 9/2009 | Brooks | |
| 8,191,845 | B1 | 6/2012 | Yu | |
| 8,267,363 | B2 | 9/2012 | Begic et al. | |
| 8,276,772 | B2 | 10/2012 | Kim | |
| 8,528,871 | B2 | 9/2013 | Begic et al. | |
| 8,573,379 | B2 | 11/2013 | Brügmann | |
| 9,206,827 | B2 | 12/2015 | Loree et al. | |
| 9,527,206 | B1 * | 12/2016 | Hsieh | B25H 3/04 |
| 10,099,363 | B1 | 10/2018 | Hsieh | |
| 10,677,388 | B2 * | 6/2020 | Hall | F16B 1/00 |
| 11,006,749 | B2 | 5/2021 | Anderson et al. | |
| 2003/0043005 | A1 * | 3/2003 | Snider | H01F 7/0257 335/284 |
| 2004/0238466 | A1 * | 12/2004 | Shiao | B25H 3/04 211/DIG. 1 |
| 2005/0247653 | A1 | 11/2005 | Brooks | |
| 2005/0269276 | A1 | 12/2005 | Pfeiffer | |
| 2006/0234846 | A1 * | 10/2006 | Tucker | B25H 3/04 483/26 |
| 2007/0125731 | A1 | 6/2007 | Waterman | |
| 2008/0000853 | A1 | 1/2008 | Huang | |
| 2008/0006592 | A1 | 1/2008 | Brooks | |
| 2008/0054142 | A1 | 3/2008 | Deland | |
| 2009/0145866 | A1 | 6/2009 | Panosian et al. | |
| 2011/0062295 | A1 | 3/2011 | Totman | |
| 2011/0147551 | A1 * | 6/2011 | Richard | A47B 96/067 29/428 |
| 2011/0234072 | A1 | 9/2011 | Hightower | |
| 2011/0303798 | A1 | 12/2011 | Bader et al. | |
| 2012/0012726 | A1 | 1/2012 | Daniels | |
| 2013/0047386 | A1 | 2/2013 | Barfoot et al. | |
| 2013/0334383 | A1 | 12/2013 | Begic et al. | |
| 2014/0263119 | A1 | 9/2014 | Gruger et al. | |
| 2016/0221178 | A1 * | 8/2016 | Hsieh | B25F 1/04 |
| 2017/0274522 | A1 | 9/2017 | Kao | |
| 2022/0040842 | A1 * | 2/2022 | Groves | F16M 13/02 |
| 2022/0347833 | A1 * | 11/2022 | Hurley | A47J 45/02 |

FOREIGN PATENT DOCUMENTS

| | | | |
|---|---|---|---|
| DE | 202020101706 | U1 | 10/2020 |
| EP | 3988251 | A1 | 4/2022 |
| GB | 2453012 | B | 6/2012 |
| WO | WO2020044340 | A1 | 3/2020 |

* cited by examiner

RAIL STORAGE SYSTEM WITH END CAPS

CROSS-REFERENCE TO RELATED APPLICATIONS

The present application claims priority to U.S. Provisional Patent Application No. 63/341,815 filed on May 13, 2022, the disclosure of which is incorporated by reference herein in its entirety.

FIELD OF THE INVENTION

The present disclosure relates generally to a rail storage system, and more particularly, to end caps for the rail storage system.

BACKGROUND OF THE INVENTION

Rail storage systems typically comprise a wall mountable rail, and accessories that connect to the rail. Such systems may be used in a garage or other similar area. The accessories are designed to hold a wide variety of consumer items such as tools, bicycles, hoses, sports equipment and other consumer articles. One disadvantage with such rail storage systems results from not having sufficient spacing between adjacent rails, in either the horizontal direction, vertical direction, or both. Without sufficient spacing between adjacent rails, the rail storage system may have insufficient spacing to use accessories such as hooks, baskets, etc. Moreover, insufficient spacing between rails in a rail storage system can result in improper weight distribution over a walled surface.

Accordingly, improved rail storage assemblies are desired in the art. In particular, rail storage assemblies which provide horizontal and vertical spacing between rails would be advantageous.

SUMMARY OF THE INVENTION

Aspects and advantages of the invention in accordance with the present disclosure will be set forth in part in the following description, or may be obvious from the description, or may be learned through practice of the technology.

In accordance with one embodiment, a storage rail assembly is provided. The storage rail assembly includes a first rail configured to be coupled to a wall. The first rail extends from a left end to a right end along a first longitudinal axis. The assembly further includes a first left end cap coupled to the left end of the rail, the left end cap including a concave pocket extending inwardly from a left face of the first left end cap and having a pocket contact surface; and a right end cap coupled to the right end of the rail, the right end cap including a projection extending outwardly from a right face of the right end cap, wherein the projection is configured to be received in a pocket of a second left end cap to form a horizontal rail assembly.

In accordance with another embodiment, an end cap system for a storage rail assembly is provided. The end cap system includes a first end cap including a body having a side face, an outer face, and a wall face, and a hollow interior defined by the outer face, the side face, and the wall face. The side face includes a first alignment feature configured to be complementary to a second alignment feature of a second end cap adjacent to the first end cap. The storage rail is configured to be received within the hollow interior of the first end cap.

These and other features, aspects and advantages of the present invention will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present invention, including the best mode of making and using the present systems and methods, directed to one of ordinary skill in the art, is set forth in the specification, which makes reference to the appended figures, in which.

DETAILED DESCRIPTION

Figure 1:
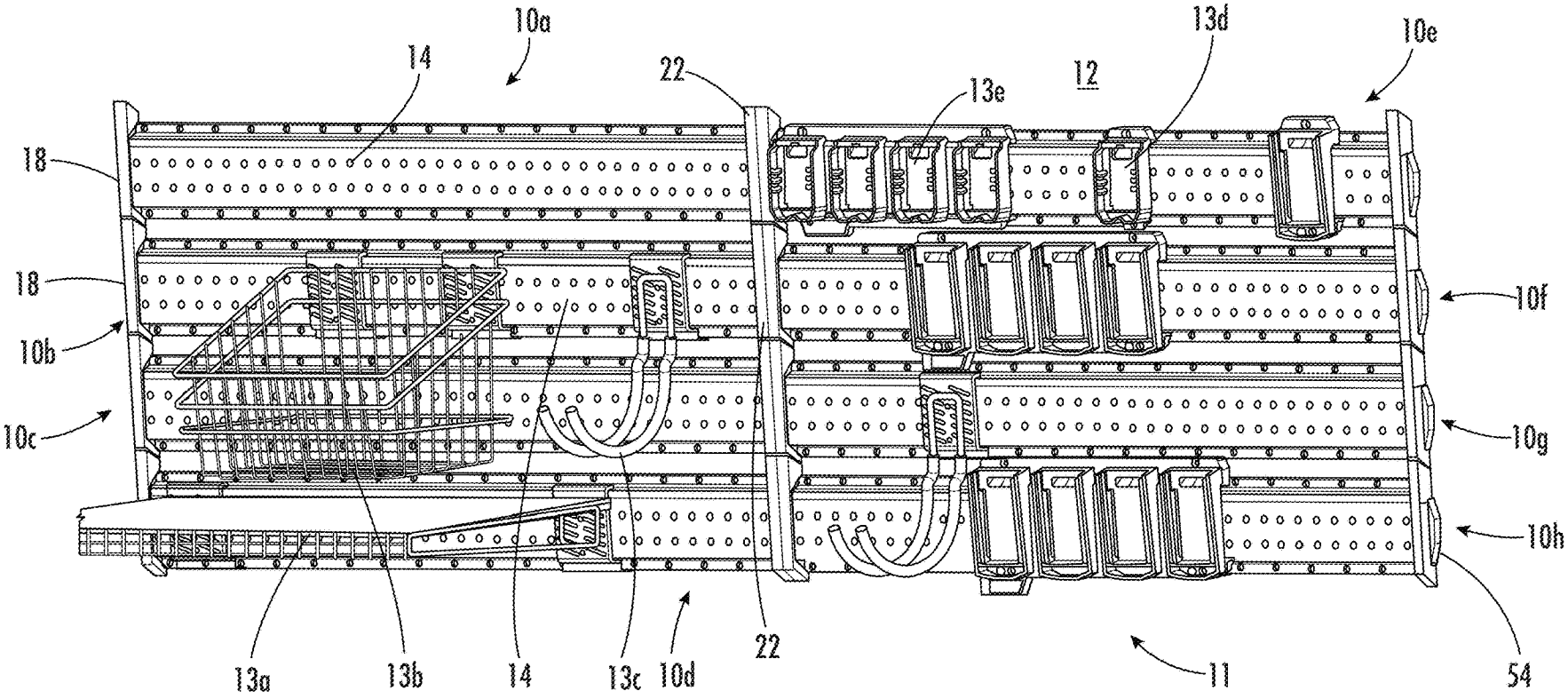
FIG. 1 is a perspective view of a rail storage system including a plurality of rail assemblies and accessories coupled to the rail assemblies.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Referring now to the drawings, FIG. 1 illustrates an exemplary rail assembly 10 that may be part of a larger storage system 11 (e.g., for a garage) to support storage accessories. The rail assembly 10 is coupled to a vertical wall 12, for instance, in a garage or other workspace, adjacent other rail assemblies 10*a*-10*h*. Accessories including, for instance, a shelf 13*a*, basket 13*b*, hooks 13*c*, a single-battery holder 13*d*, or a multiple-battery holder 13*e*, may be coupled to the rail assembly 10. The accessories may engage the rail assembly 10 in a snapped engagement or other coupling arrangement.

Figure 2:
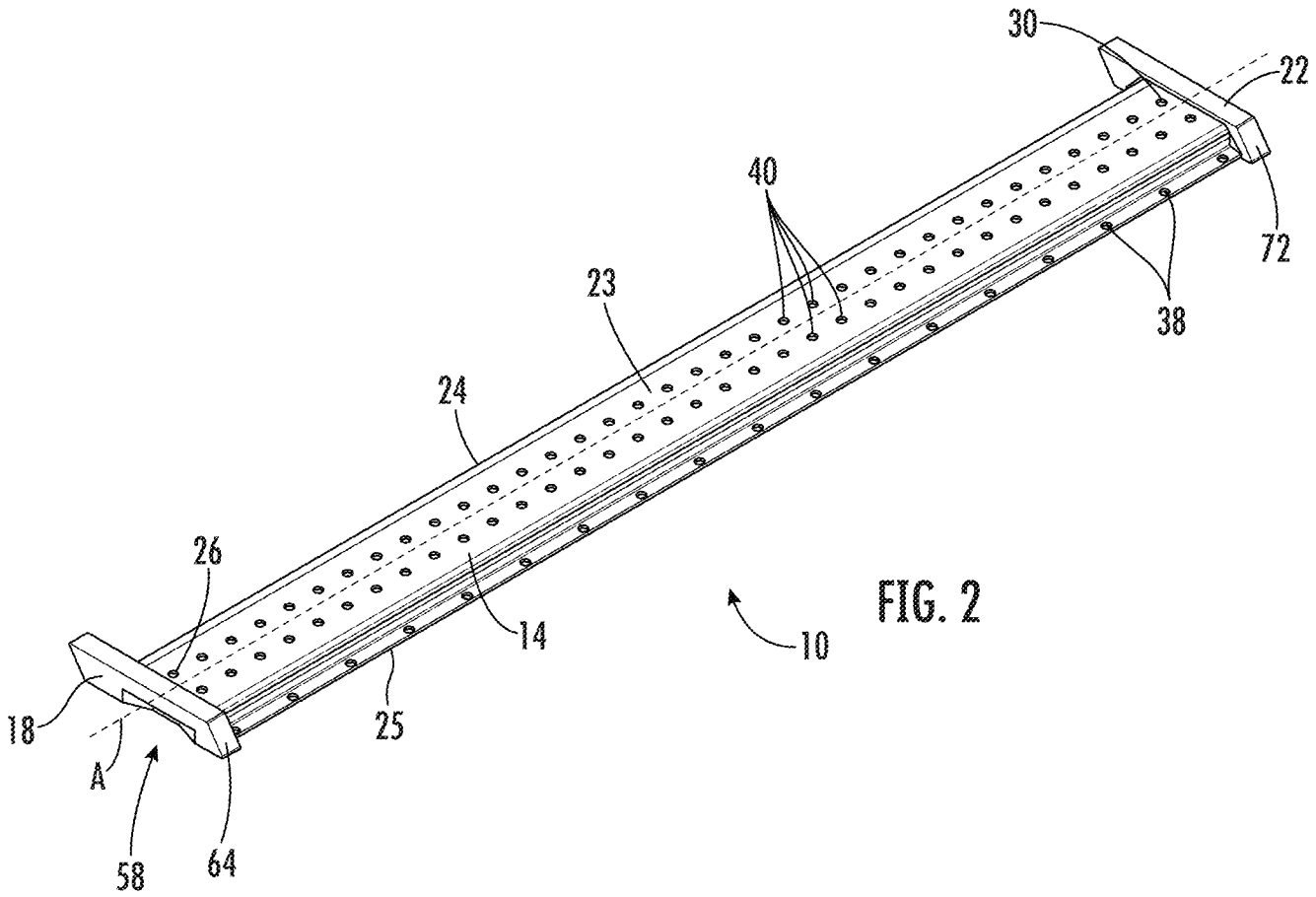
FIG. 2 is a perspective view of a rail assembly including a rail, a left end cap coupled to a left end of the rail, and a right end cap coupled to a right end of the rail.

FIG. 2 illustrates an exemplary rail assembly 10. The rail assembly 10 includes a rail 14, a left end cap 18, and a right end cap 22. The rail 14 has a mounting face 23 that extends along a longitudinal axis A between a left end 26 and a right end 30. The rail 14 includes and top and bottom flanges 24, 25 extending along the upper edge and lower edge of the rail 14 on the top and bottom sides, respectively, of the mounting face 23 and also extending between the left end 26 and right end 30. The rail 14 may have a length in a range from about 15 inches to about 50 inches, such as from about 30 inches to about 40 inches, for instance, a length of about thirty-five inches, between the left end 26 and right end 30, or another appropriate length. The rail 14 may be coupled to the wall 12 using fasteners (not shown) inserted through holes 38 that are spaced equidistantly, for instance, two inches apart or any other desirable spacing, along the top and bottom flanges 24, 25. The rail 14 may include a pegboard, that is, pairs of holes 40 spaced equidistantly along the mounting face 23.

Figure 3:
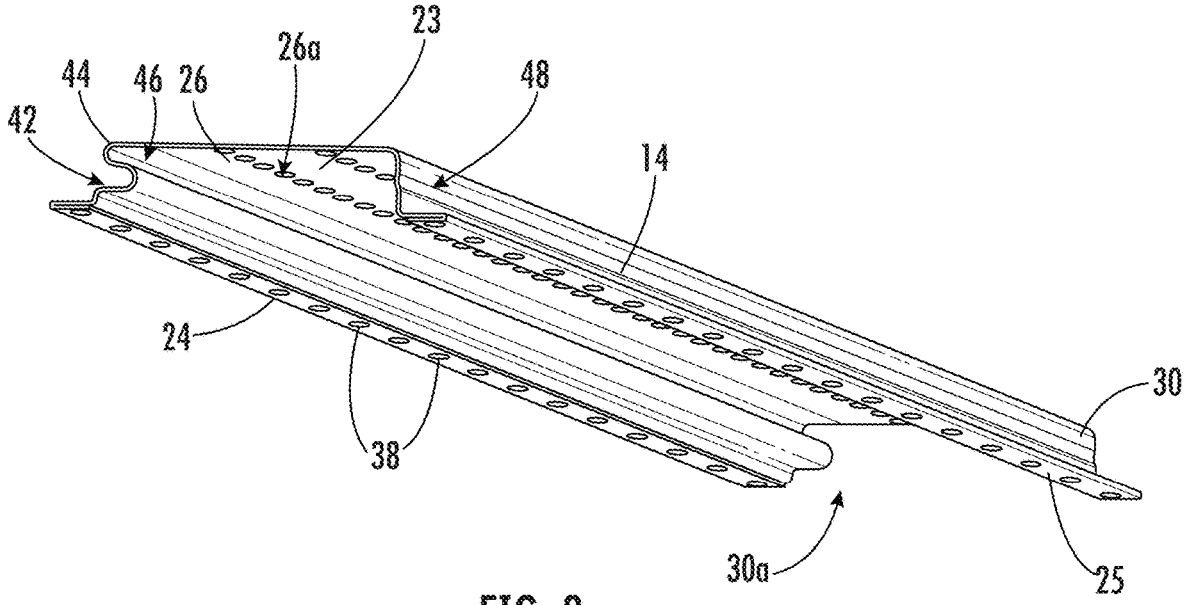
FIG. 3 is a perspective view of the rail of FIG. 2.

FIG. 3 illustrates a rail 14 with no left end cap 18 or right end cap 22. The left end 26 has an exposed left open end 26*a*, and the right end 30 has an exposed right open end 30*a*. Additionally, as best seen in FIG. 3, the rail 14 includes a trough 42 and a peak 44 with an interior 46 that extend along the longitudinal axis A between the mounting face 23 and the top flange 24. The rail 14 also includes a crease 48 that extends along the longitudinal axis A between the mounting face 23 and the bottom flange 25. The left end 26 and right end 30 of the rail 14 define a left open end 26*a* and a right open end 30*a*.

Figure 4:
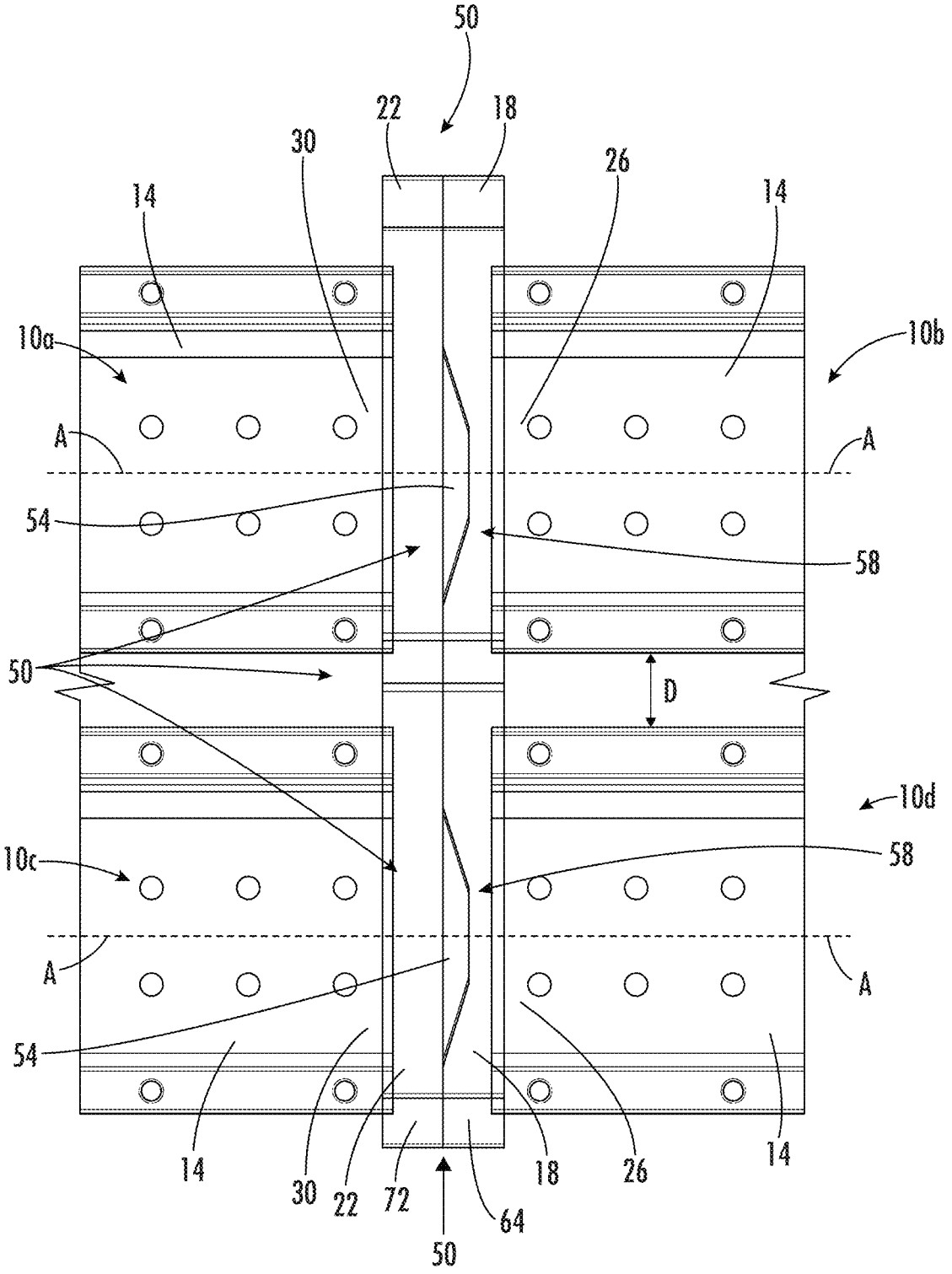
FIG. 4 is a top view of a portion of rail storage system of FIG. 1 illustrating the interaction between left and right end caps.

As shown in FIG. 4, in a rail assembly 10, the left end cap 18 is coupled to the left end 26 of the rail 14 and supports the rail 14 relative to adjacent rail assemblies 10. In this regard, the left end cap 18 encloses the left open end 26*a*. The right end cap 22 is coupled to the right end 30 of the rail 14 and supports the right end 30 of the rail 14 relative to adjacent rail assemblies 10. The right end cap 22 is inserted into and encloses the right open end 30*a* of the rail 14.

Figure 5:
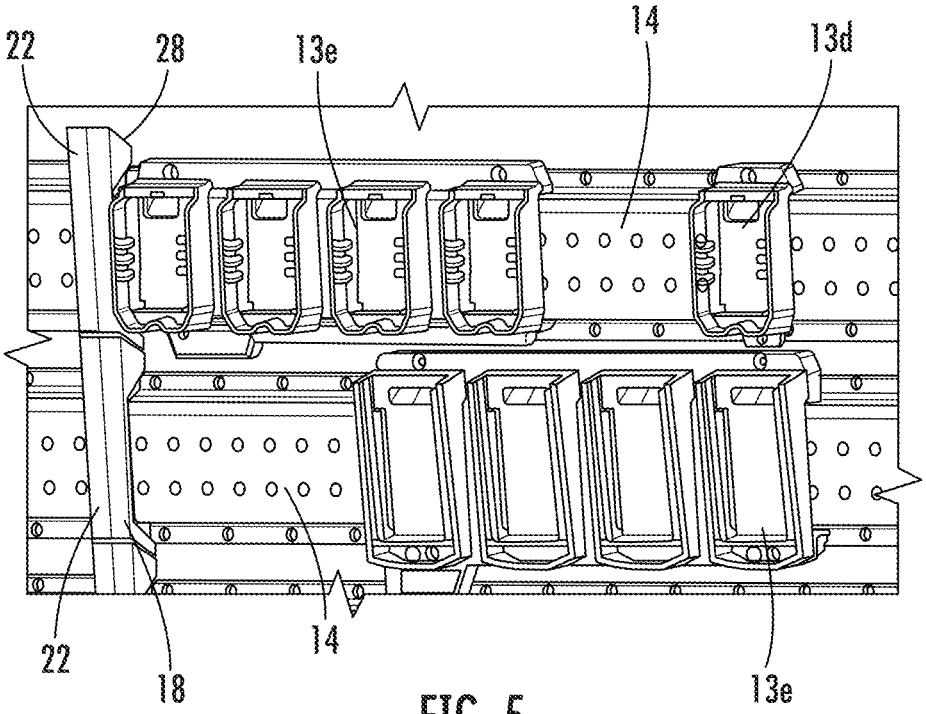
FIG. 5 is an enlarged perspective view of the rail storage system of FIG. 1.
Figure 6:
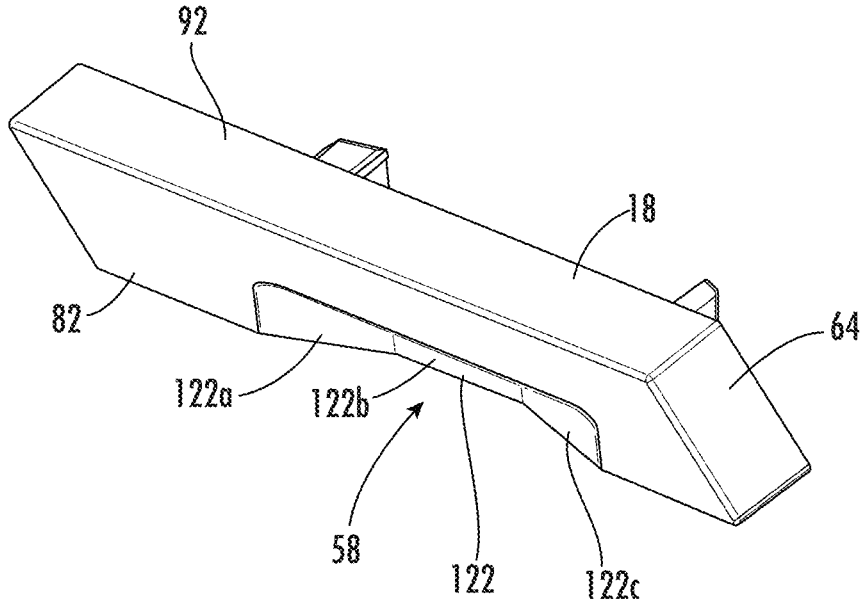
FIG. 6 is a perspective view of the left end cap of FIG. 2.
Figure 7:
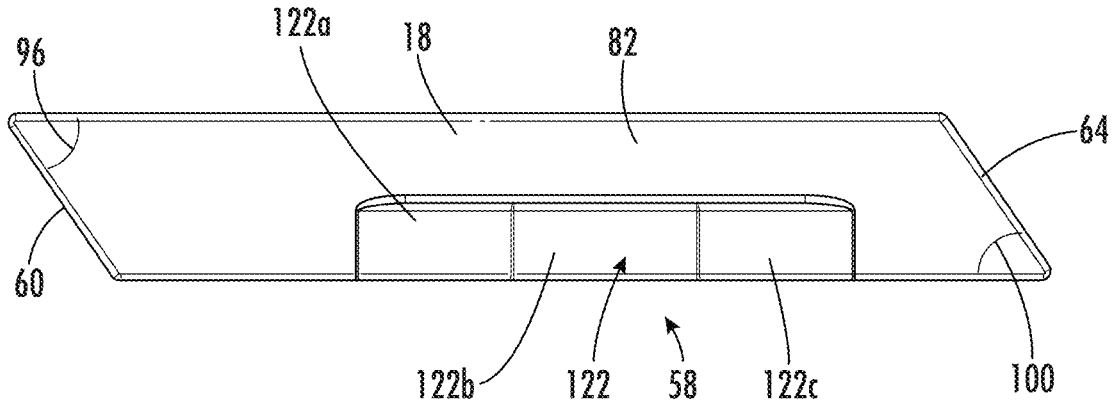
FIG. 7 is a left side view of the left end cap of FIG. 6.
Figure 8:
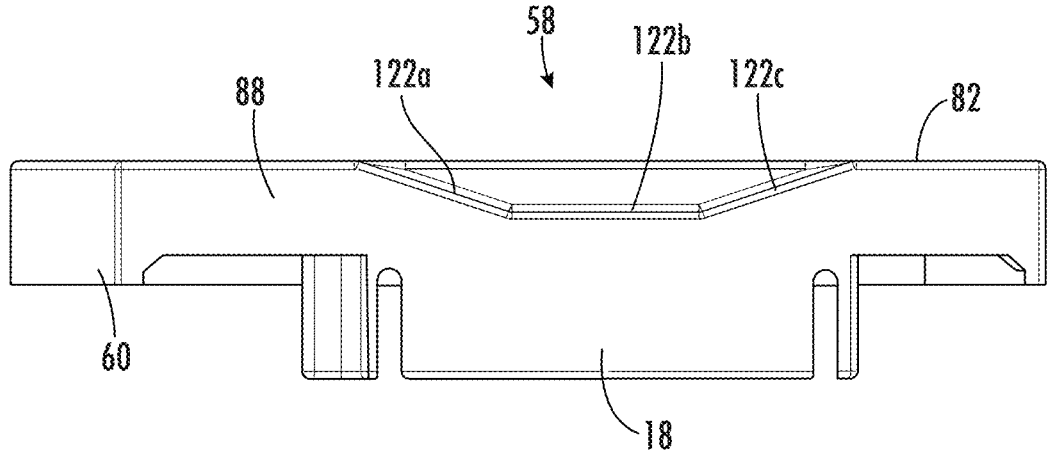
FIG. 8 is a bottom side view of the left end cap of FIG. 6.

The left end cap 18 and right end cap 22 include alignment features 50 that interact to align, support, and distribute the weight of the rail assemblies 10. The alignment features 50 interact to align the axes A of horizontally adjacent rail assemblies 10. More particularly, the right end cap 22 of the rail assembly 10*a* includes a projection 54 that is received in a pocket 58 of the left end cap 18 of a horizontally adjacent rail assembly 10*b*, which interlock the horizontally adjacent rail assemblies 10. The alignment features 50 also vertically space the rails 14 of vertically adjacent rail assemblies 10 and generally evenly distribute the weight of the rail assemblies 10. The alignment features 50 also include first and second contact faces 60, 64 of the left end cap 18 and first and second contact faces 68, 72 of the right end cap 22. As illustrated in FIG. 5, the alignment features 50 vertically space the rail assemblies 10 to allow use of accessories on vertically adjacent rail assemblies 10 with limited or no interference between accessories, such as vertically stacked hooks 13*c* or battery holders 13*d*, 13*e*.

With reference to FIGS. 6-10, the body of the left end cap 18 is shown in more detail. The illustrated left end cap 18 has a parallelogram shape and includes a left face 82 (side face), an opposite right face 86 (FIG. 9), a wall face 88, and an outer face 92. The wall face 88 is positioned adjacent the wall 12 when the rail assembly 10 is coupled to the wall 12 and the outer face 92 is spaced from the wall 12. The left end cap 18 also includes a first contact face 60 (upper contact face) and second contact face 64 (lower contact face). When the rail assembly 10 is coupled to a wall, the first contact face 60 is positioned in a direction vertically above of the second contact face 64, as viewed by the user. The first contact face 60 extends at an angle 96 relative to the outer face in a direction downward and inward toward the center of the left end cap 18 to form an upper acute angle. The angle 96 may be an acute angle. The angle 96 may be in a range from about 10 degrees to about 80 degrees, such as from about 15 degrees to about 75 degrees, for instance from about 25 degrees to about 65 degrees. The second contact face 64 extends from the wall face 88 to the outer face 92 in a direction upward and inward at an angle 100 to form a lower acute angle that may be equivalent to the angle 96 of the first contact face 60. While the left end cap 18 is illustrated as having a parallelogram shape, the left end cap may have a different shape.

When rail assemblies 10 are coupled to a wall 12 in vertical positioning, i.e., with one rail assembly 10 mounted vertically above another rail assembly 10 with both extending in a horizontal direction along the axis A, the point of the parallelogram of the first rail assembly 10, which is defined by the second contact face 64, may nest with the second rail assembly 10. The first contact face 60 and the second contact face 64 may contact each other.

The left face 82 includes a pocket 58 extending inwardly from the left face 82 along an exterior of the left end cap 18, and that has an inner surface 122, also referred to as a pocket contact surface. The pocket 58 forms a concave recess (concave pocket) on the left face 82 of the left end cap 18. The pocket 58 may be disposed adjacent to the wall face 88 of the left end cap 18. As shown, the inner surface 122 may be prismatic and divided into different surface portions 122*a*, 122*b*, 122*c*. In other constructions, the inner surface 122 may be curved. The pocket 58 may have other geometric relationships. As described in further detail below, the particular geometry of the pocket 58 is not critical as long as the shape and size of the pocket 58 is a concave recess that is configured to receive a projection 54 from a right end cap 22 therein. In some aspects of the present invention, the size and shape of the pocket 58 may be complementary to the size and shape of the projection 54.

Figure 9:
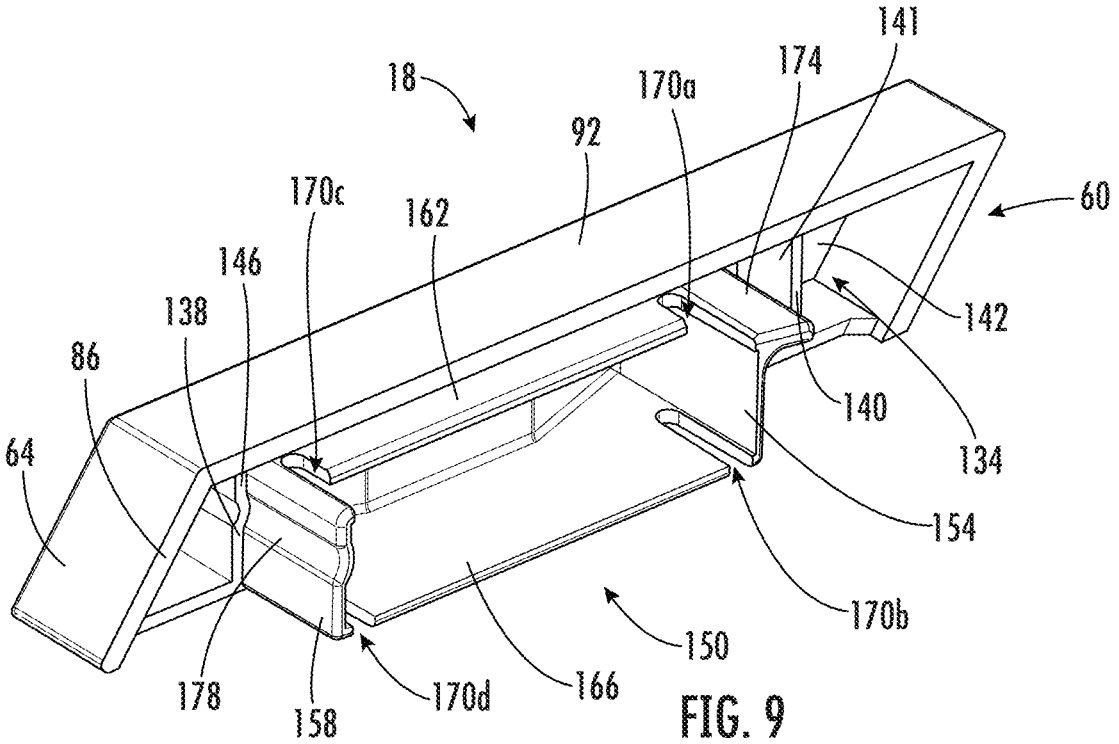
FIG. 9 is another perspective view of the left end cap of FIG. 6 illustrating the right side of the left end cap.
Figure 10:
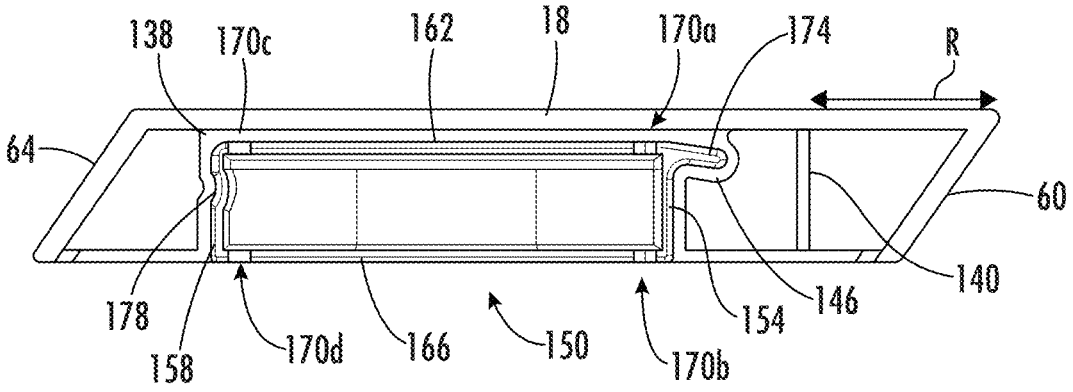
FIG. 10 is a right side view of the left end cap of FIG. 6.
Figure 11:
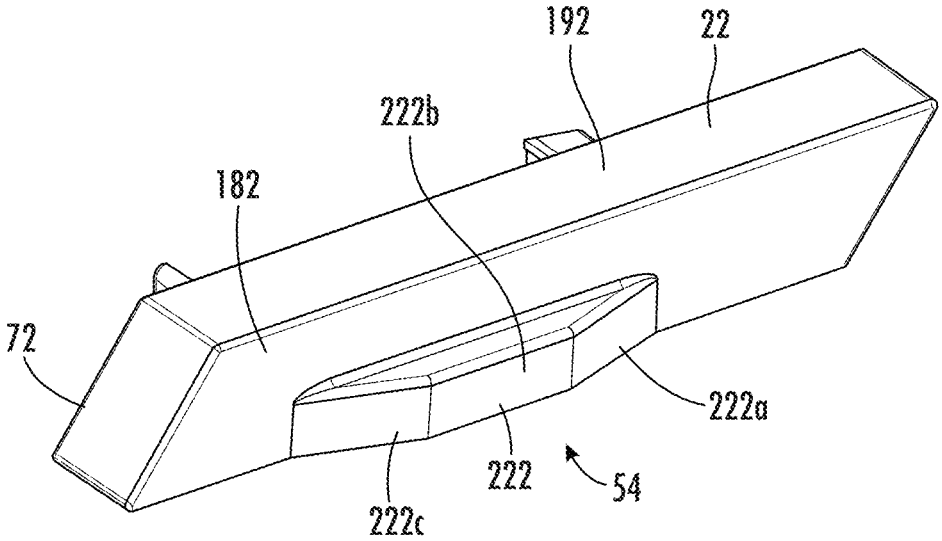
FIG. 11 is a perspective view of the right end cap of FIG. 2.
Figure 12:
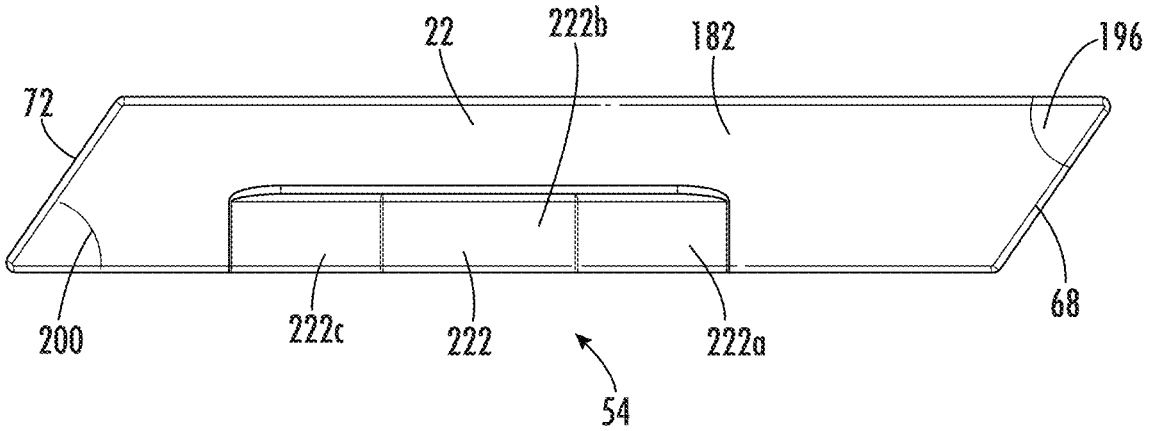
FIG. 12 is a right side view of a right end cap of FIG. 11.
Figure 13:
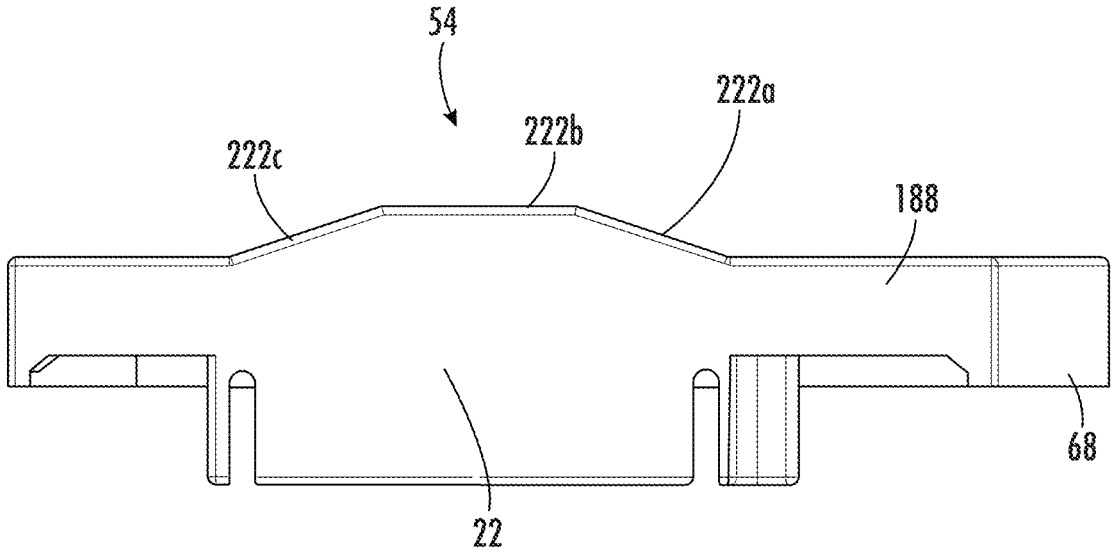
FIG. 13 is a bottom side view of the right end cap of FIG. 11.

As shown in FIGS. 9 and 10, the left end cap 18 has a hollow interior 134 and a lattice 138 extending from an interior side 142 of the left face 82 toward the right face 86. The lattice 138 has a lattice face 146 that is offset from the right face 86 in a direction toward the left face 82, i.e., within the hollow interior 134. When the left end cap 18 is coupled to the rail 14, the lattice face 146 abuts the open left end 26*a* of the rail 14 whereby the left end cap 18 overlaps the left end 26 of the rail 14. The left end cap 18 further includes a rib 140 extending from an interior side 142 of the left face 82 toward the right face 86. The rib 140 is disposed between the first contact face 60 and the protrusion 174 (described below). The rib 140 may provide additional structural integrity and stability to the left end cap 18 in an assembled state of the storage rail assembly 10. Additionally, the rib 140 may prevent the rail 14 from sliding upward toward the first contact face 60 when the rail 14 is coupled with the left end cap 18, thereby aiding in maintaining spacing between vertically adjacent rails 14. The rib 140 may be spaced a distance R from the first contact face 60 when measured along the outer surface 92.

The left end cap 18 may be coupled to the rail 14 by a rail mount extension 150. The rail mount extension 150 extends from the interior side 142 of the left face 82 toward and beyond the right face 86. The rail mount extension 150 defines a first portion 154, a second portion 158, and first and second bridges 162, 166 joining the first portion 154 and second portion 158. The first and second bridges 162, 166 extend from the first portion 154 to the second portion 158 and include cutouts 170*a*, 17*b*, 17*c*, 170*d* adjacent the first portion 154 and second portion 158. A protrusion 174 extends from the first portion 154 adjacent the first bridge 162 away from the second portion 158 and in a direction generally perpendicular to the axis A. The second portion 158 includes an arcuate recess 178.

When the left end cap 18 is coupled to the rail 14, the rail mount extension 150 is disposed in the left open end 26*a* of the rail 14. The protrusion 174 is configured to be disposed in the interior 46 of the peak 44 of the rail 14. In this regard, the top flange 24 is configured to be disposed behind the protrusion 174, i.e., closer to the wall 12, when the rail assembly 10 is mounted to the wall 12. The crease 48 of the rail 14 is configured to be nested with the recess 178 of the second portion 158. The first portion 154 and second portion 158 of the rail mount extension 150 are frictionally engaged with the top flange 24 and bottom flange 25 of the rail 14. The cutouts 170*a-d* permit flexing of the first and second portions 154, 158 which permit insertion of the rail mount extension 150 through the left open end 26*a*.

The protrusion 174 is a poke yoke feature that prevents the left end cap 18 from being coupled to the right open end 30*a* of the rail 14. In other words, the protrusion 174 is configured to prevent inadvertent improper assembly of the rail assembly 10. If the right open end 30*a* of the rail 14 is attempted to be coupled with the left end cap 18, i.e., with the rail 14 disposed upside down with the bottom flange 25 facing upward, the protrusion 174 would interfere with the bottom flange 25 of the rail 14 to prevent insertion of the right open end 30*a* into the left end cap 18.

FIGS. 11-15 illustrate the body of the right end cap 22, which has a parallelogram shape and includes a right face 182 (side face), an opposite left face 186 (FIG. 14), a wall face 188 and an outer face 192. The wall face 188 is positioned adjacent the wall 12 when the rail assembly 10 is coupled to the wall 12 and the outer face 192 is spaced from the wall 12. The right end cap 22 also includes a first contact face 68 (upper contact face) and second contact face 72 (lower contact face). When the rail assembly 10 is coupled to a wall, the first contact face 68 may be positioned in a direction vertically above of the second contact face 72, as viewed by the user. The first contact face 68 extends at an angle 196 relative to the outer face 192 in a direction downward and inward toward the center of the right end cap 22 to form an upper acute angle. The angle 196 may be an acute angle. The angle 196 may be in a range from about 10 degrees to about 80 degrees, such as from about 15 degrees to about 75 degrees, for instance from about 25 degrees to about 65 degrees. The second contact face 72 extends from the wall face 188 to the outer face 192 in a direction upward and inward at an angle 200 to form a lower acute angle that may be equivalent to the angle 196 of the first contact face 68. While the right end cap 22 is illustrated as having a parallelogram shape, the right end cap 22 may have a different geometric shape.

When rail assemblies 10 are coupled to a wall 12 and oriented vertically relative to each other, the point of the parallelogram of the first rail assembly 10*a* (FIG. 4), which is defined by the second contact face 72, will nest in the second rail assembly 10*b*. The first contact face 68 and the second contact face 72 may contact each other.

A projection 54 extends outwardly from the right face 182. For instance, the projection 54 may be adjacent to and extend from the wall face 188 of the right end cap 22. The projection 54 has an outer surface 222, also referred to as a projection contact surface. The outer surface 222 may be prismatic and divided into different surface portions 222*a*, 222*b*, 222*c*. In other constructions, the outer surface 222 may be curved. The projection 54 may have other geometric relationships. As described in further detail below, the particular geometry of the projection 54 is not critical as long as the shape and size of the projection 54 is configured to fit within a pocket 58 of a left end cap 18 therein. In some aspects of the present invention, the size and shape of the projection 54 may be complementary to the size and shape of the pocket 58. The projection 54 of the right end cap 22 and pocket 58 of the left end cap 18 form alignment features 50. As such, the pocket 58 may be shaped to receive the projection 54 when at least two rail assemblies 10 are coupled to a wall 12 horizontally adjacent one another, as illustrated in, e.g., FIG. 4.

Figure 14:
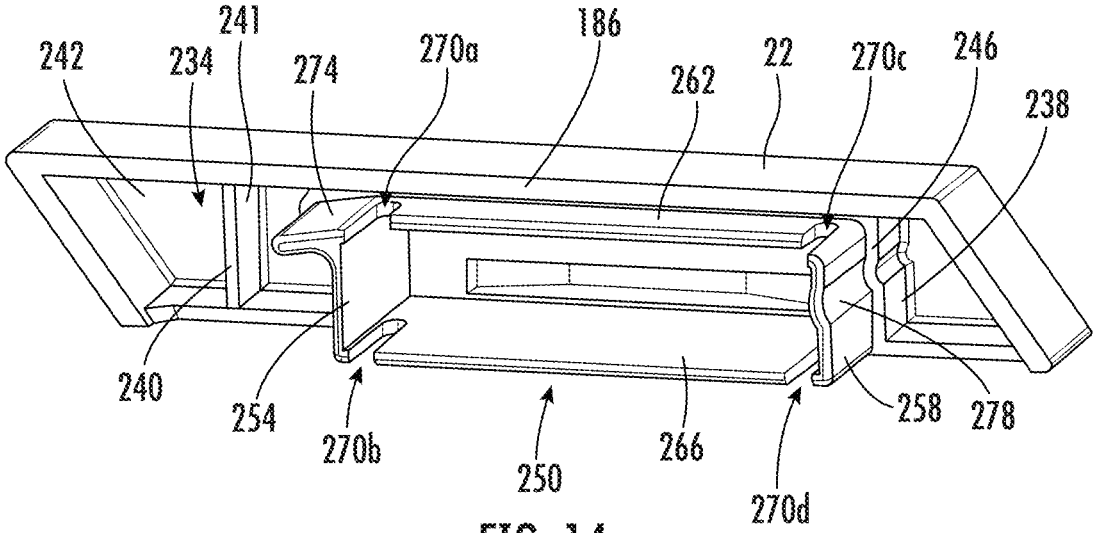
FIG. 14 is a perspective view of a left side of the right end cap of FIG. 11.
Figure 15:
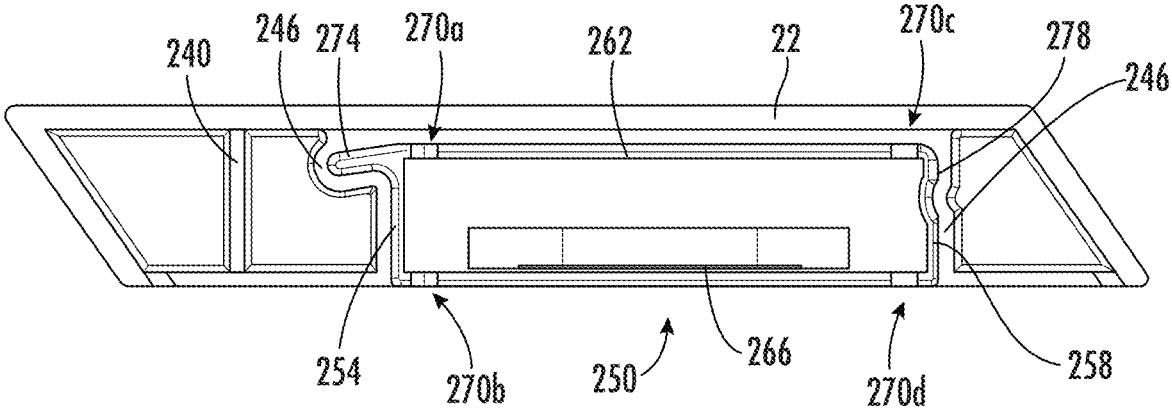
FIG. 15 is a left side view of the right end cap of FIG. 11.

As shown in FIGS. 14 and 15, the right end cap 22 has a hollow interior 234 and a lattice 238 extending from an interior side 242 of the right face 182 toward the left face 186. The lattice 238 has a lattice face 246 that is offset from the left face 186 in a direction toward the right face 182, i.e., in the hollow interior 234. When the right end cap 22 is coupled to the rail 14, the lattice face 246 is configured to abut the right end 30 of the rail 14 and the right end cap 22 overlaps the right end 30 of the rail 14. The right end cap 22 further includes a rib 240 extending from an interior side 242 of the right face 182 toward the left face 186. The rib 240 is disposed between the first contact face 68 and the protrusion 274 (described below). The rib 240 may provide additional structural integrity and stability to the right end cap 22 in an assembled state of the storage rail assembly 10. Additionally, the rib 240 may prevent the rail 14 from sliding upward toward the first contact face 68 when the rail 14 is coupled with the right end cap 22, thereby aiding in maintaining spacing between vertically adjacent rails 14. The rib 240 may be spaced a distance R from the first contact face 68 when measured along the outer surface 192.

The right end cap 22 may be coupled to the rail 14 by a rail mount extension 250. The rail mount extension 250 extends from the interior side 242 of the right face 182 toward and beyond the left face 186. The rail mount extension 250 defines a first portion 254, a second portion 258, a first bridge 262 and a second bridge 266. The first and second bridges 262, 266 extend from the first portion 254 to the second portion 258 and include cutouts 270*a*-270*d* adjacent the first portion 254 and second portion 258. A protrusion 274 extends from the first portion 254 adjacent the first bridge 264 in a direction away from the second portion 258. The second portion 258 includes an arcuate recess 278.

When the right end cap 22 is coupled to the right end 30 of the rail 14, the rail mount extension 250 is disposed in the right open end 30*a* at the right end 30 of the rail 14. The protrusion 274 is disposed in the interior 46 of the peak 44. The protrusion 274 prevents the right end cap 22 from being coupled to the left end 26 of the rail 14, as the protrusion 274 would interfere with the bottom flange 25 of the rail 14. The crease 48 of the rail 14 is nested with the recess 278 of the second portion 258. The first portion 254 and second portion 258 of the right end cap 22 are frictionally engaged with the top flange 24 and bottom flange 25 of the rail 14. The cutouts 270*a-d* permit the first portion 254 and second portion 258 of the rail mount extension 250 to flex when the rail mount extension 250 is inserted into the right open end 30*a*.

The protrusion 274 is a poka yoke feature that prevents the right end cap 22 from being coupled to the left open end 26*a* of the rail 14. In other words, the protrusion 274 is configured to prevent inadvertent improper assembly of the rail assembly 10. If the left open end 26*a* of the rail 14 is attempted to be coupled with the right end cap 22, i.e., with the rail 14 disposed upside down with the bottom flange 25 facing upward, the protrusion 274 would interfere with the bottom flange 25 of the rail 14 to prevent insertion of the left open end 26*a* into the right end cap 22.

Turning back to FIG. 1, a storage system 11 including a plurality of rail assemblies 10 is illustrated. A first rail assembly 10*a*, second rail assembly 10*b*, third rail assembly 10*c*, and fourth rail assembly 10*d* are mounted to wall 12 in a vertical orientation, with the first rail assembly 10*a* disposed at a highest height and the fourth rail assembly 10*d* disposed at a lowest height. The second contact face 64 of the left end cap 18 of rail assembly 10*a* (first rail assembly) aligns with and contacts the first contact face 60 of the left end cap 18 of rail assembly 10*b* (second rail assembly) disposed vertically adjacent below rail assembly 10*a*. Similarly, the second contact face 72 of the right end cap 22 of rail assembly 10*a* aligns with and contacts the first contact face 68 of the right end cap 22 of rail assembly 10*b* disposed vertically adjacent below rail assembly 10*a*.

As illustrated in, e.g., FIG. 1 and FIG. 4, each of the rails 14 that are disposed vertically adjacent above or below each other are spaced by a distance D. The distance D is at least as long as the distance R of each of the left end cap 18 and right end cap 22, i.e., a distance between the ribs 140, 240 and the first contact faces 60, 68 along the outer surfaces 92, 192 of the left end cap 18 and right end cap 22, respectively. The distance D can be in a range from about 1 cm to about 20 cm including any incremental distance therebetween. The spacing distance D is at least as long as a projection of any of the accessories 13*a-e* above or below a rail 14 when coupled to the rail 14, e.g., as illustrated in FIG. 1. For instance, the single battery holder 13*d* and/or multiple battery holder 13*e* may extend above or below each of the rails 14 when coupled with the storage rail assembly 10 to an extent that is less than or equal to the distance D.

In an identical manner as that described above with regard to the vertical orientation of the first through fourth rail assemblies 10*a-d*, a fifth rail assembly 10*e*, a sixth rail assembly 10*f*, a seventh rail assembly 10*g*, and an eighth rail assembly 10*h* are mounted to wall 12 in a vertical orientation.

Further, the first rail assembly 10*a* and the fifth rail assembly 10*e* are mounted to the wall 12 horizontally adjacent to each other such that the first rail assembly 10*a* and the fifth rail assembly 10*e* share a longitudinal axis A and form a horizontal rail assembly. The right end cap 22 of rail assembly 10*a* is adjacent to, and may contact, the left end cap 18 of rail assembly 10*e*. For instance, the right face 182 of the right end cap 22 may contact the left face 82 of the left end cap 18. Further, the projection 54 of the right end cap 22 may be inserted within the pocket 58 of the adjacent left end cap 18. More particularly, the surface portions 222*a*, 222*b*, 222*c* of the projection 54 may align with and/or come into contact with the surface portions 122*a*, 122*b*, 122*c* of the pocket 58. By utilizing the alignment features 50, e.g., the projection 54 and pocket 58, the right end cap 22 and left end cap 18 may be aligned in parallel along the axis A, and as a result, the respective horizontally adjacent rails 14 may be aligned in parallel along the axis A. The outer surface 92 of the left end cap 18 and the outer surface 192 of the right end cap 22 may form a generally coplanar surface, with the projection 54 and pocket 58 aligning along the wall surfaces 88, 188 of the left end cap 18 and right end cap 22.

As illustrated in FIG. 1, the second and sixth rail assemblies 10*b* and 10*f*, third and seventh rail assemblies 10*c* and 10*g*, and fourth and eighth rail assemblies 10*d* and 10*h* are similarly mounted horizontally adjacent to each other as described above with regard to the first and fifth rail assemblies 10*a*, 10*e* to form a series of parallel horizontal rail assemblies. In the embodiment of the storage system 11 illustrated FIG. 1, four rows of two rail assemblies 10 each are formed. In this regard, each of the rail assemblies 10*a-h* are mounted to form parallel, level rows having equal (equidistant) spacing between each.

Further aspects of the invention are provided by one or more of the following embodiments:

A storage rail assembly includes a first rail configured to be coupled to a wall. The first rail extends from a left end to a right end along a first longitudinal axis. The assembly further includes a first left end cap coupled to the left end of the rail, the left end cap including a concave pocket extending inwardly from a left face of the first left end cap and having a pocket contact surface; and a right end cap coupled to the right end of the rail, the right end cap including a projection extending outwardly from a right face of the right end cap, wherein the projection is configured to be received in a pocket of a second left end cap to form a horizontal rail assembly.

The storage rail assembly of any one or more of the embodiments, wherein the projection has a projection contact surface, wherein the projection contact surface is configured to align with a pocket contact surface of the pocket of the second left end cap.

The storage rail assembly of any one or more of the embodiments, wherein the second left end cap and the right end cap each comprise a wall surface configured to be disposed adjacent to the wall and an outer surface parallel to the respective wall surface, wherein when the projection is received within the pocket of the second left end cap, the outer surface of the second left end cap and the outer surface of the right end cap are configured to be coplanar.

The storage rail assembly of any one or more of the embodiments, wherein the projection is adjacent to the wall surface of the right end cap, and the pocket of the second left end cap is adjacent to the wall surface of the second left end cap.

The storage rail assembly of any one or more of the embodiments, wherein the first left end cap includes a first contact face and a second contact face, wherein the first contact face of the first left end cap is configured to contact a second contact face of a third left end cap such that the first left end cap and the third left end cap are vertically aligned.

The storage rail assembly of any one or more of the embodiments, wherein the third left end cap is coupled to a left open end of a second rail, wherein the second rail extends from the left open end to a right end along a second longitudinal axis that is parallel to the first longitudinal axis.

The storage rail assembly of any one or more of the embodiments, wherein the first rail and the second rail are spaced apart by a distance D in a direction perpendicular to the first longitudinal axis and the second longitudinal axis.

The storage rail assembly of any one or more of the embodiments, further comprising an accessory mounted to one of the first rail or the second rail, wherein the accessory extends into a space between the first rail and the second rail in a vertical direction.

The storage rail assembly of any one or more of the embodiments, wherein the first left end cap and the third left end cap are vertically aligned along an axis that is perpendicular to the first longitudinal axis.

The storage rail assembly of any one or more of the embodiments, wherein the first contact face and the second contact face of the first left end cap are configured to be disposed at an acute angle relative to the wall when the first left end cap is mounted parallel to the wall.

The storage rail assembly of any one or more of the embodiments, wherein the first left end cap comprises a hollow interior, wherein the left end of the first rail is configured to be received within the hollow interior.

The storage rail assembly of any one or more of the embodiments, wherein the first left end cap comprises a rail mount extension disposed in the hollow interior of the left end cap, wherein the rail mount extension is coupled to a left open end of the rail.

The storage rail assembly of any one or more of the embodiments, wherein the rail mount extension comprises a poke yoke feature configured to prevent improper coupling between the first left end cap and the end of the rail.

The storage rail assembly of any one or more of the embodiments, wherein the rail comprises a mounting face configured to be disposed parallel to the wall and extending between an upper edge and a lower edge, and a trough disposed between the upper edge and the mounting face, further wherein the rail mount extension comprises a projection configured to extend within the trough when the first left end cap and the first rail are coupled, wherein the projection of the rail mount extension is the poke yoke feature.

An end cap system for a storage rail assembly includes a first end cap including a body having a side face, an outer face, and a wall face, and a hollow interior defined by the outer face, the side face, and the wall face. The side face includes a first alignment feature configured to be complementary to a second alignment feature of a second end cap adjacent to the first end cap. The storage rail is configured to be received within the hollow interior of the first end cap. The end cap system of claim 15, further comprising the second end cap, wherein the second end cap comprises a body having a side face comprising the second alignment feature, an outer face, and a wall face, and a hollow interior defined by the outer face, the side face, and the wall face.

The end cap system of any one or more of the embodiments, further comprising an upper contact face and a lower contact face, wherein each of the upper contact face and the lower contact face extend from the outer face to the wall face.

The end cap system of any one or more of the embodiments, wherein an upper acute angle is formed between the outer face and the upper contact face, and a lower acute angle is formed between the wall face and the lower contact face The end cap system of any one or more of the embodiments, wherein the upper acute angle and the lower acute angle are approximately equal such that the outer face and the wall face are parallel to each other.

The end cap system of any one or more of the embodiments, further comprising a rail mount extension disposed within the hollow interior of the first end cap, wherein the rail mount extension comprises a poke yoke feature configured to prevent improper coupling between the storage rail and the rail mount extension.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A storage rail assembly comprising:

a first rail extending from a left end to a right end along a first longitudinal axis, the first rail configured to be coupled to a wall;

a first left end cap coupled to the left end of the first rail, the first left end cap including a concave pocket extending inwardly from a left face of the first left end cap and having a pocket contact surface, a right end cap coupled to the right end of the first rail, the right end cap including a projection extending outwardly from a right face of the right end cap, wherein the projection is configured to be received in a pocket of a second left end cap to form a horizontal rail assembly; and wherein the first left end cap comprises a hollow interior, wherein the left end of the first rail is configured to be received within the hollow interior.

2. The storage rail assembly of claim 1, wherein the projection has a projection contact surface, wherein the projection contact surface is configured to align with a pocket contact surface of the pocket of the second left end cap.

3. The storage rail assembly of claim 1, wherein the second left end cap and the right end cap each comprise a wall surface configured to be disposed adjacent to the wall and an outer surface parallel to the respective wall surface, wherein when the projection is received within the pocket of the second left end cap, the outer surface of the second left end cap and the outer surface of the right end cap are configured to be coplanar.

4. The storage rail assembly of claim 3, wherein the projection is adjacent to the wall surface of the right end cap, and the pocket of the second left end cap is adjacent to the wall surface of the second left end cap.

5. The storage rail assembly of claim 1, wherein the first left end cap includes a first contact face and a second contact face, wherein the first contact face of the first left end cap is configured to contact a second contact face of a third left end cap such that the first left end cap and the third left end cap are vertically aligned.

6. The storage rail assembly of claim 5, wherein the third left end cap is coupled to a left open end of a second rail, wherein the second rail extends from the left end to a right end along a second longitudinal axis that is parallel to the first longitudinal axis.

7. The storage rail assembly of claim 6, wherein the first rail and the second rail are spaced apart by a distance D in a direction perpendicular to the first longitudinal axis and the second longitudinal axis.

8. The storage rail assembly of claim 6, further comprising an accessory mounted to one of the first rail or the second rail, wherein the accessory extends into a space between the first rail and the second rail in a vertical direction.

9. The storage rail assembly of claim 5, wherein the first left end cap and the third left end cap are vertically aligned along an axis that is perpendicular to the first longitudinal axis.

10. The storage rail assembly of claim 5, wherein the first contact face and the second contact face of the first left end cap are configured to be disposed at an acute angle relative to the wall when the first left end cap is mounted parallel to the wall.

11. The storage rail assembly of claim 1, wherein the first left end cap comprises a rail mount extension disposed in the hollow interior of the left end cap, wherein the rail mount extension is coupled to a left open end of the first rail.

12. The storage rail assembly of claim 11, wherein the rail mount extension comprises a poke yoke feature configured to prevent improper coupling between the first left end cap and the end of the first rail.

13. The storage rail assembly of claim 12, wherein the first rail comprises a mounting face configured to be disposed parallel to the wall and extending between an upper edge and a lower edge, and a trough disposed between the upper edge and the mounting face, further wherein the rail mount extension comprises a projection configured to extend within the trough when the first left end cap and the first rail are coupled, wherein the projection of the rail mount extension is the poke yoke feature.

14. An end cap system for a storage rail assembly, the storage rail comprising a rail extending from a left end to a right end, the end cap system comprising:

a first end cap comprising a body having a side face, an outer face, and a wall face, and a hollow interior defined by the outer face, the side face, and the wall face, wherein the side face comprises a first alignment feature configured to be complementary to a second alignment feature of a second end cap adjacent to the first end cap, and wherein the storage rail is configured to be received within the hollow interior of the first end cap.

15. The end cap system of claim 14, further comprising the second end cap, wherein the second end cap comprises a body having a side face comprising the second alignment feature, an outer face, and a wall face, and a hollow interior defined by the outer face, the side face, and the wall face.

16. The end cap system of claim 14, further comprising an upper contact face and a lower contact face, wherein each of the upper contact face and the lower contact face extend from the outer face to the wall face.

17. The end cap system of claim 16, wherein an upper acute angle is formed between the outer face and the upper contact face, and a lower acute angle is formed between the wall face and the lower contact face.

18. The end cap system of claim 17, wherein the upper acute angle and the lower acute angle are approximately equal such that the outer face and the wall face are parallel to each other.

19. The end cap system of claim 14, further comprising a rail mount extension disposed within the hollow interior of the first end cap, wherein the rail mount extension comprises a poke yoke feature configured to prevent improper coupling between the storage rail and the rail mount extension.

* * * * *